US007841470B2

(12) United States Patent
Chin

(10) Patent No.: US 7,841,470 B2
(45) Date of Patent: Nov. 30, 2010

(54) SMALL ARTICLE PACKAGE

(76) Inventor: Kam Chin, 17600 Newhope St., Fountain Valley, CA (US) 92708

( * ) Notice: Subject to any disclaimer, the term of this patent is extended or adjusted under 35 U.S.C. 154(b) by 0 days.

(21) Appl. No.: 12/291,935

(22) Filed: Nov. 15, 2008

(65) Prior Publication Data

US 2010/0122923 A1 May 20, 2010

(51) Int. Cl.
*B65D 73/00* (2006.01)

(52) U.S. Cl. ..... 206/462; 206/461; 206/470; 206/307.1; 206/307; 206/722

(58) Field of Classification Search ..... 206/462, 206/463, 470, 473, 307.1, 307, 723; 220/4.23, 220/839

See application file for complete search history.

(56) References Cited

U.S. PATENT DOCUMENTS 3,111,220 A * 11/1963 Bostrom ..... 206/539
3,424,380 A * 1/1969 Curran ..... 239/60
4,060,173 A * 11/1977 Dahl ..... 220/4.23
4,512,474 A * 4/1985 Harding ..... 206/461
4,681,223 A * 7/1987 Roberts ..... 206/354
4,687,129 A * 8/1987 Cugley ..... 220/315
4,724,964 A * 2/1988 Hernandez ..... 206/461
4,779,734 A * 10/1988 Kydonieus ..... 206/470
6,308,832 B1 * 10/2001 Pirro et al. ..... 206/469
6,719,139 B1 * 4/2004 Foos et al. ..... 206/462
7,255,230 B1 * 8/2007 Appelbaum ..... 206/463
7,306,159 B1 * 12/2007 Rochelo ..... 235/492
7,475,816 B1 * 1/2009 Rochelo ..... 235/386
2003/0010670 A1 * 1/2003 Dobler ..... 206/581
2006/0000738 A1 * 1/2006 Kumakura et al. ..... 206/470
2008/0272025 A1 * 11/2008 Lee ..... 206/701

* cited by examiner

*Primary Examiner*—David T Fidei
(74) *Attorney, Agent, or Firm*—Clement Cheng

(57) ABSTRACT

A small article package has a card front member having a card front member blister receiving opening, a button snap performed on the card front member, a card rear member attached to the card front member, and the card rear member has a card rear member blister receiving opening. A button depression releasably engages the button snap in interference fit and the blister package has a front panel, a rear panel, and a flange protruding from the blister package. The flange extends between the card front member and the card rear member. The blister package fits within the blister receiving opening which is sized to receive the blister package. The front panel is hinged to the rear panel. A rear panel plateau on the blister package extends upward from the flange. A depression is formed on the rear panel plateau for receiving a small article.

21 Claims, 8 Drawing Sheets

SMALL ARTICLE PACKAGE

DISCUSSION OF RELATED ART

When packaging small articles for retail consumption, such as flash memory, it is helpful to display product information. Unfortunately, product information typically cannot be printed on the article itself. Placing the article within a cardboard box is typically not desirable because the packaging waste is excessive and the increase in volume is not necessary. Therefore, a useful design for a small article package is needed in the marketplace. Furthermore, the small article package should decrease waste as well as be environmentally friendly, while at the same time provide enough surface area for printing and also protect the small article during shipping and handling.

SUMMARY OF THE INVENTION

The present invention uses a bifold paper card having a blister receiving opening which is cut out in a middle portion of the card. The bifold paper card can be formed of two separate sheets of card stock, or a single card folded at an upper edge, lower edge, left edge, or right edge. The bifold paper card can be glued together to prevent opening. The blister receiving opening provides for retention of a flange of the blister package. While the flange is sandwiched between the upper and lower card members, the remainder of the plastic blister package is revealed to the user. The button snap receiver can be square, rectangular or round, but preferably square or rectangular.

The blister package has a rear panel and a front panel. An intermediate panel optionally joins the rear panel and front panel. The intermediate panel may be folded along an intermediate panel front score or an intermediate panel rear score. The blister package is preferably formed from a sheet of plastic that is pressed to shape, thereby forming the three panels, namely the front panel, rear panel and intermediate panel. The front panel preferably includes a window panel portion that is preferably a depression on the front panel such that the front panel has a higher level than the window panel level. The front panel further includes a button snap which is an indentation forming a button which is grasped by a depression formed in the rear panel. The rear panel has a protruding flange, preferably protruding along an upper edge, left edge, right edge and bottom edge. The rear panel has a rear panel plateau at a higher level than the flange. The intermediate panel is given leeway from an intermediate panel flange notch formed in the rear panel, and an intermediate panel plateau notch formed in the rear panel. At a lower edge of the rear panel plateau, a grip depression is formed as a spherical profile indentation. The rear panel plateau includes a pair of rear panel side walls, and a rear panel bottom wall.

Optionally, the blister package further includes an SD card depression for storing an SD sized and shaped flash memory card. The card depression is above a rectangular depression. The memory card depression is bounded at a top portion by a top tab, and bounded at a bottom portion by a bottom tab. The top tab extends over a top edge of the memory card, and the bottom tab extends over a bottom edge of the memory card. The rectangular depression forms a rectangular cavity below the memory card. The rectangular cavity can be used to store paper instructions, such as a folded sheet of paper. The front panel is preferably substantially flat, except for the window panel and the pair of button snaps.

In an alternate corner snap embodiment, the button snap can be formed as a corner snap. The corner snap embodiment front panel is not flat, but rather has a depression on a bottom surface of the front panel with four corners extending downward. The rear panel plateau in the corner snap embodiment has four corner snap depressions receiving four corners of the front panel. The alternate corner snap embodiment may include a slot for a USB Key. Alternatively, the slot can be in the shape of a memory card for retaining a memory card. The slot can also receive and be in the shape of a clamshell container holding a memory card.

The corner snap embodiment may further include a lower wall extending around the rear panel plateau. A rear panel bottom wall gap optionally provides a rectangular depression for retaining a rectangular object below the USB Key or memory card clamshell container. The rectangular object can be a small instruction booklet made of a folded sheet of paper. The rectangular object can also be promotional materials, advertising, a product manual, product registration or other paper product.

A number of variations in the design of the present invention may be desirable. The intermediate panel can be made with only the intermediate panel front score, or with only the intermediate panel rear score so that there is a single joint on the intermediate panel instead of a double joint. The intermediate panel is made longer when single jointed. The intermediate panel becomes a part of the front panel when the intermediate panel front score is omitted, and the intermediate panel becomes a part of the rear panel when the intermediate panel rear score is omitted.

The blister package can be flipped upside down so that the button snaps are at the top and the hinge or hinges of the intermediate panel allow the front panel to fold downward. The blister package can also be oriented 90° to place the intermediate panel at a right side or left side, which allows the front panel to open like a book, or reversed from a standard book opening configuration when the intermediate panel is on the right side. The button snaps can be relocated on the front panel so that they are closer together in the middle, or further apart on the sides.

The button latch can be made as a round circular depression, a square depression, or a rectangular depression. The round button latch is preferred for insertion into a square button snap receiver.

The package can also be reversed with respect to the card so that the product package front faces in an opposite direction away from the front panel rather than in the same direction with the front panel. Because the blister package is preferably made of transparent plastic, the reversal of the package when flipped provides viewing of the contents in the rectangular depression when the product is displayed.

The following callout list of elements may assist in identifying the elements of this invention.

102 Bifold Card Front Member
104 Bifold Card Rear Member
110 Rear Panel
121 Flange
122 Rear Panel Sidewall
131 Rear Panel Bottom Wall
132 Grip Depression
135 Rear Panel Bottom Wall Gap
140 Lower Wall
150 Intermediate Panel
152 Intermediate Panel Rear Score
153 Intermediate Panel Front Score
151 Intermediate Panel Flange Notch
126 Intermediate Panel Plateau Notch
125 Rear Panel Plateau
161 Bottom Tab
162 Top Tab
210 Front Panel
221 Window Panel
222 Button Snap
228 Corner Snap
229 Corner Snap Depression
284 Product Slot
281 Square Button Snap
282 Card Depression
283 Rectangular Depression
284 Package Slot
298 Square Button Snap Receiver
818 Printed Material
888 Flash Memory Device

DETAILED DESCRIPTION OF THE PREFERRED EMBODIMENT

Figure 5:
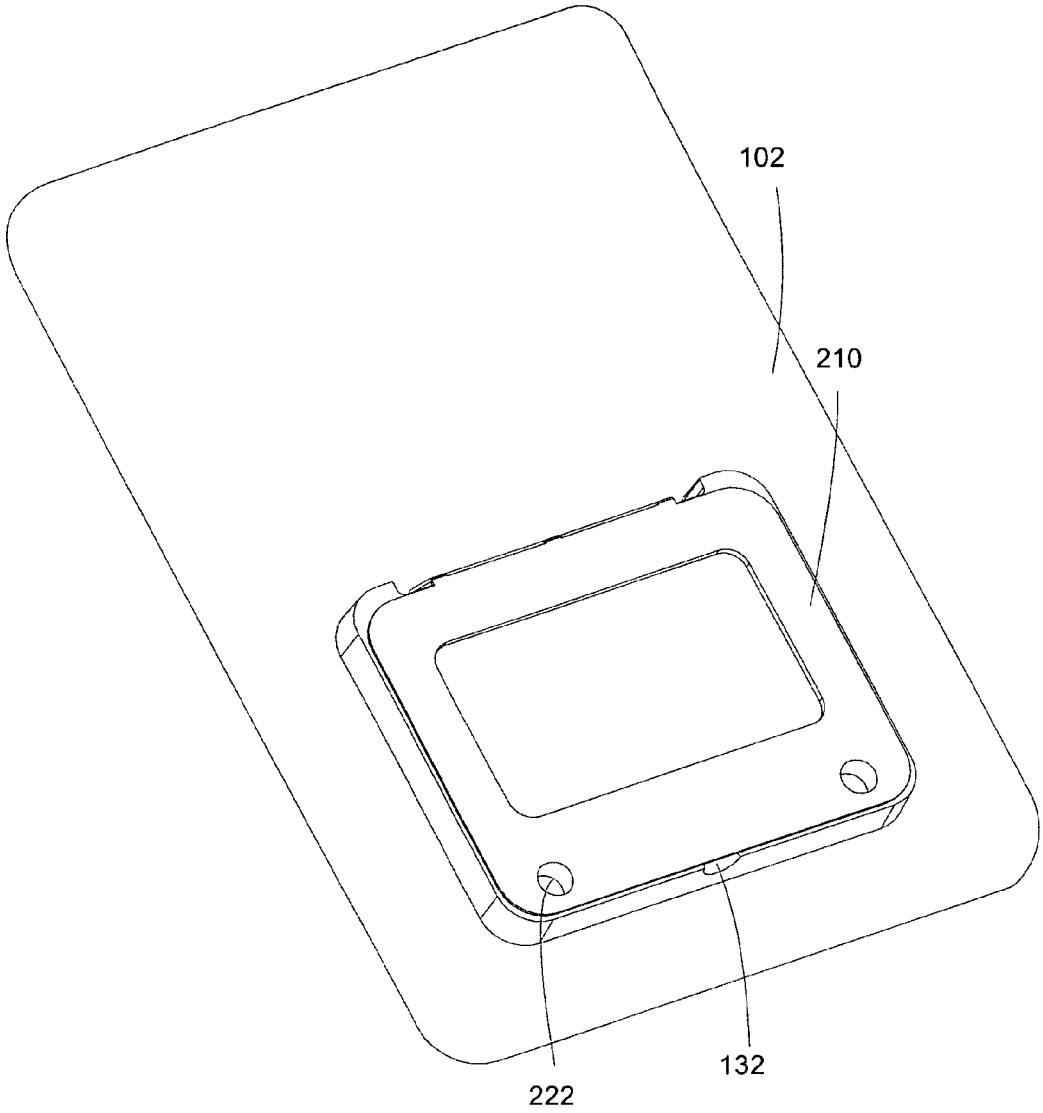
FIG. 5 is a front perspective view-of the present invention with the card.
Figure 6:
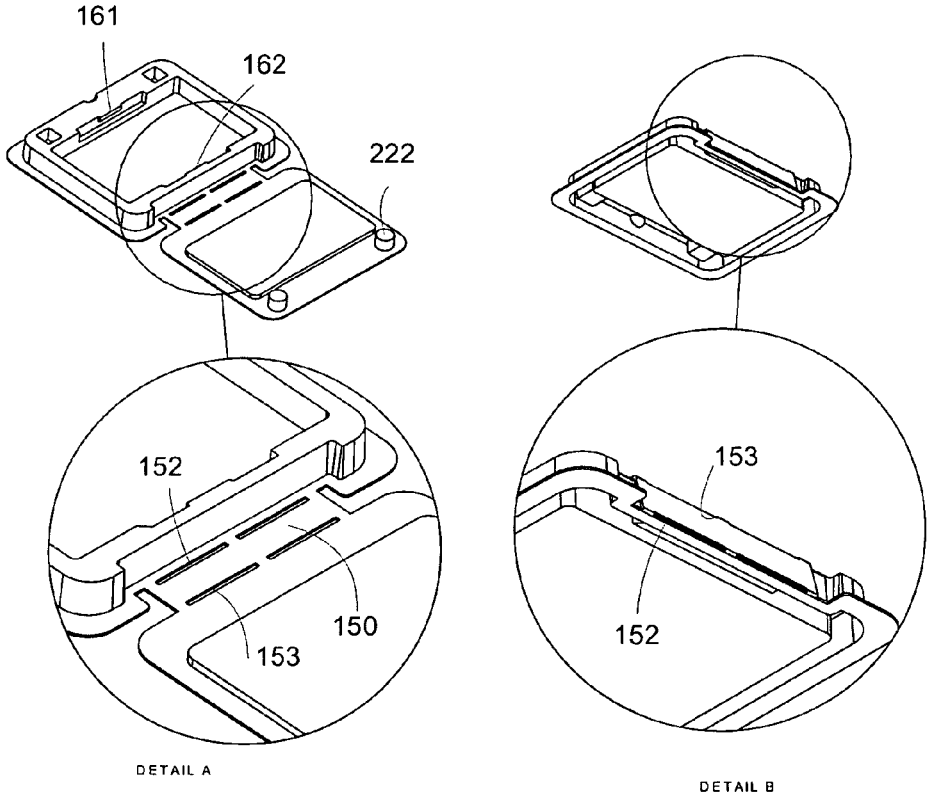
FIG. 6 is a detail view of the joint area in open and closed position.

The present invention uses a bifold paper card 102, FIG. 5 having a blister receiving opening which is cut out in a middle portion of the card 102. The bifold paper card can be formed of two separate sheets of card stock, or a single card folded at an upper edge, lower edge, left edge, or right edge. A single card sheet folded has a bifold card front member 102 and a bifold card rear member 104, and each card member has a blister receiving opening to form a pair of blister receiving openings. The bifold paper card can be glued together to prevent opening. The blister receiving opening provides for retention of a flange 121 of the blister package. While the flange 121 is sandwiched between the upper 102 and lower card 104 members, the remainder of the plastic blister package is revealed to the user. The button snap receiver 298 can be square, rectangular or round, but preferably square or rectangular.

The blister package has a rear panel 110 and a front panel 210. An intermediate panel 150 optionally joins the rear panel 110 and front panel 210. The intermediate panel 150 may be folded along an intermediate panel front score 153 or an intermediate panel rear score 152. The blister package is preferably formed from a sheet of plastic that is pressed to shape, thereby forming the three panels, namely the front panel 210, rear panel 110 and intermediate panel 150. The front panel 210 preferably includes a window panel depression portion 221 that is preferably a shallow depression on the front panel such that the front panel has a higher level than the window panel level. The front panel further includes a button snap 222 which is an indentation forming a button which is grasped by a button depression formed in the rear panel. The button depression snugly receives the button snap 222 to provide a reusable, releasable and reclosable interference fit on a portion of the exterior surfaces of the button snap. The button snap and button depression have slight deformation during engagement. The rear panel 110 has a protruding flange 121, preferably protruding along an upper edge, left edge, right edge and bottom edge. The rear panel has a rear panel plateau 125 at a higher level than the flange. The intermediate panel is given leeway from an intermediate panel flange notch 151 formed in the rear panel, and an intermediate panel plateau notch 126 formed in the rear panel. At a lower edge of the rear panel plateau, a grip depression 132 is formed as a spherical profile indentation. The grip depression is sized to allow grasp of a lower edge of the front panel. The rear panel plateau 125 includes a pair of rear panel side walls 122, and a rear panel bottom wall 131.

Figure 1:
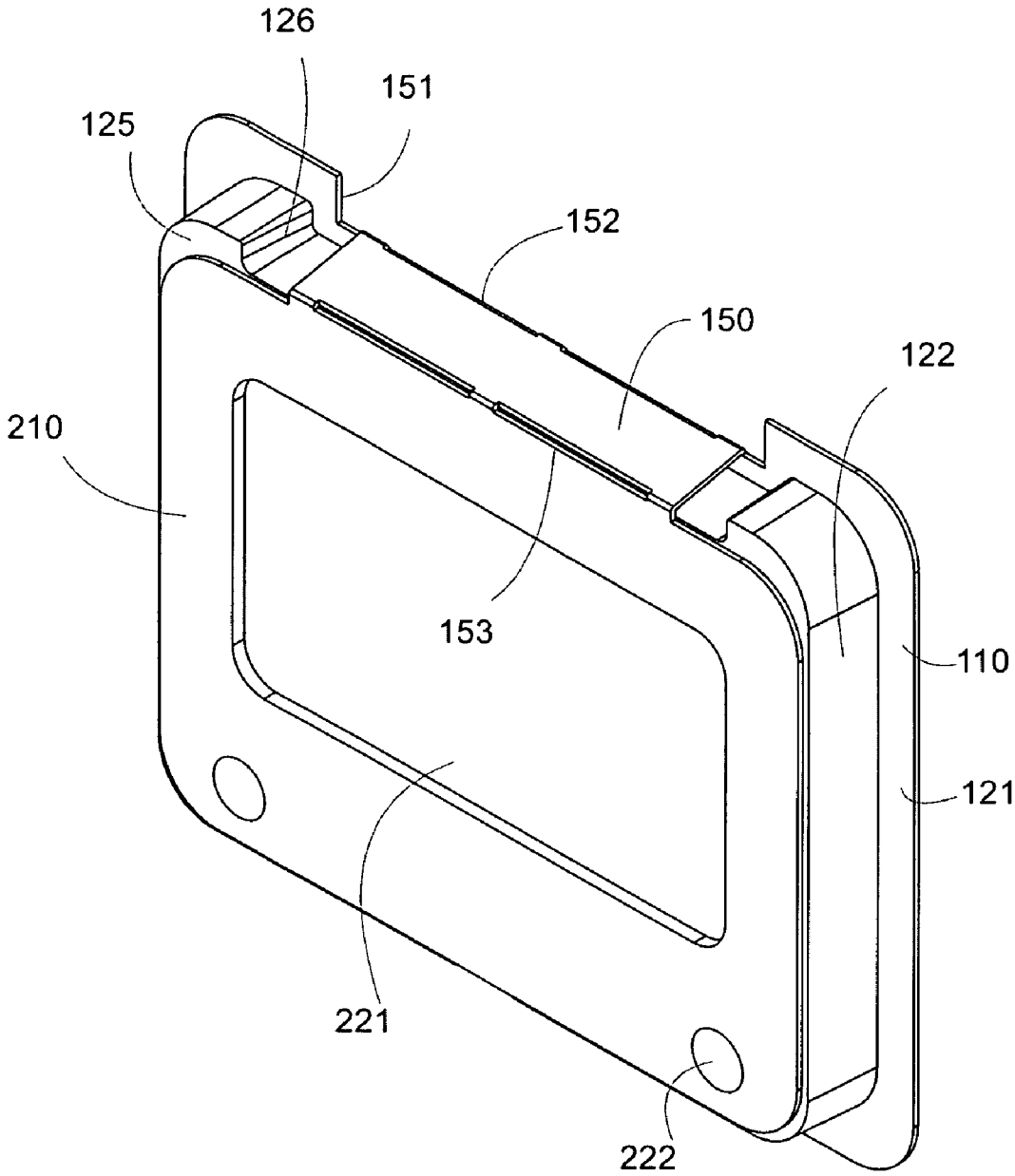
FIG. 1 is a perspective view of the present invention.
Figure 2:
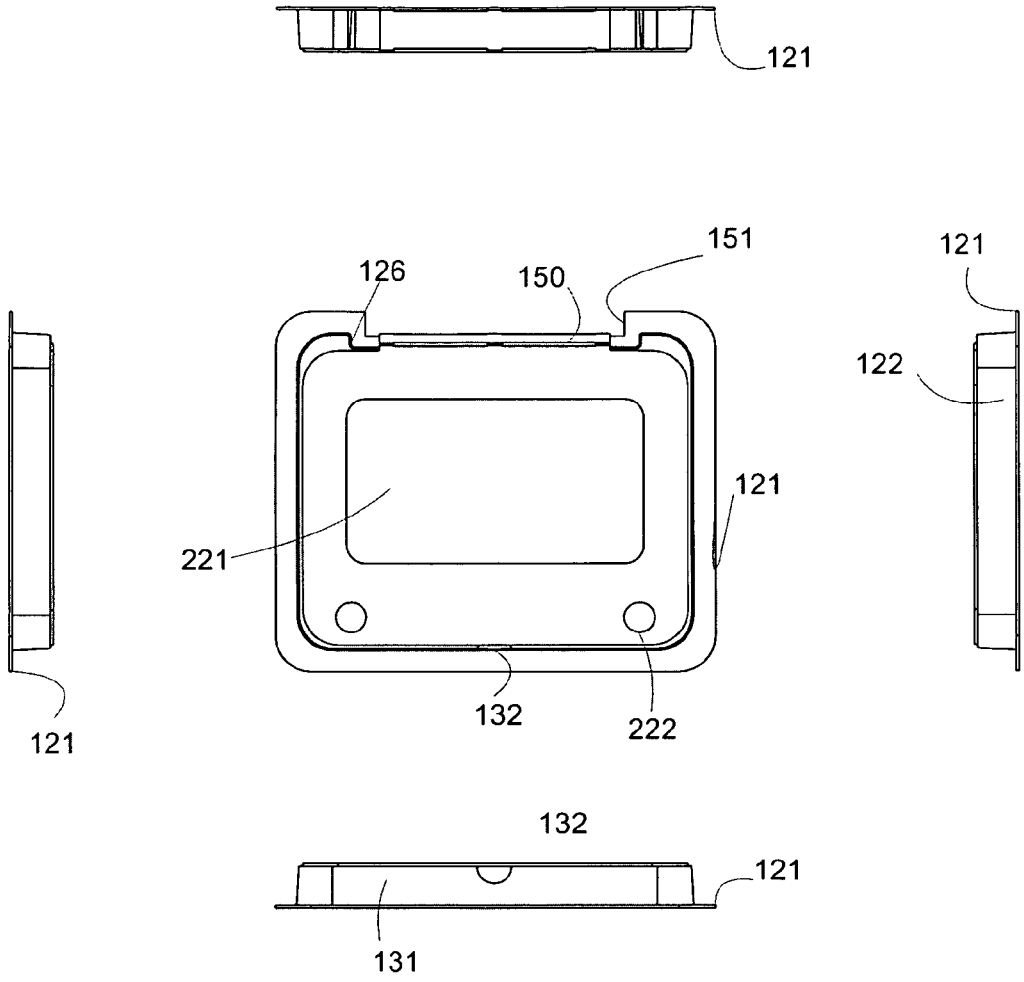
FIG. 2 is a diagram of five plan views of the present invention, with front plan view surrounded by a top plan view above the front plan view, a bottom plan view of below the front plan view, a left plan view to the left of the front plan view, and a right plan view to the right of the front plan view.
Figure 3:
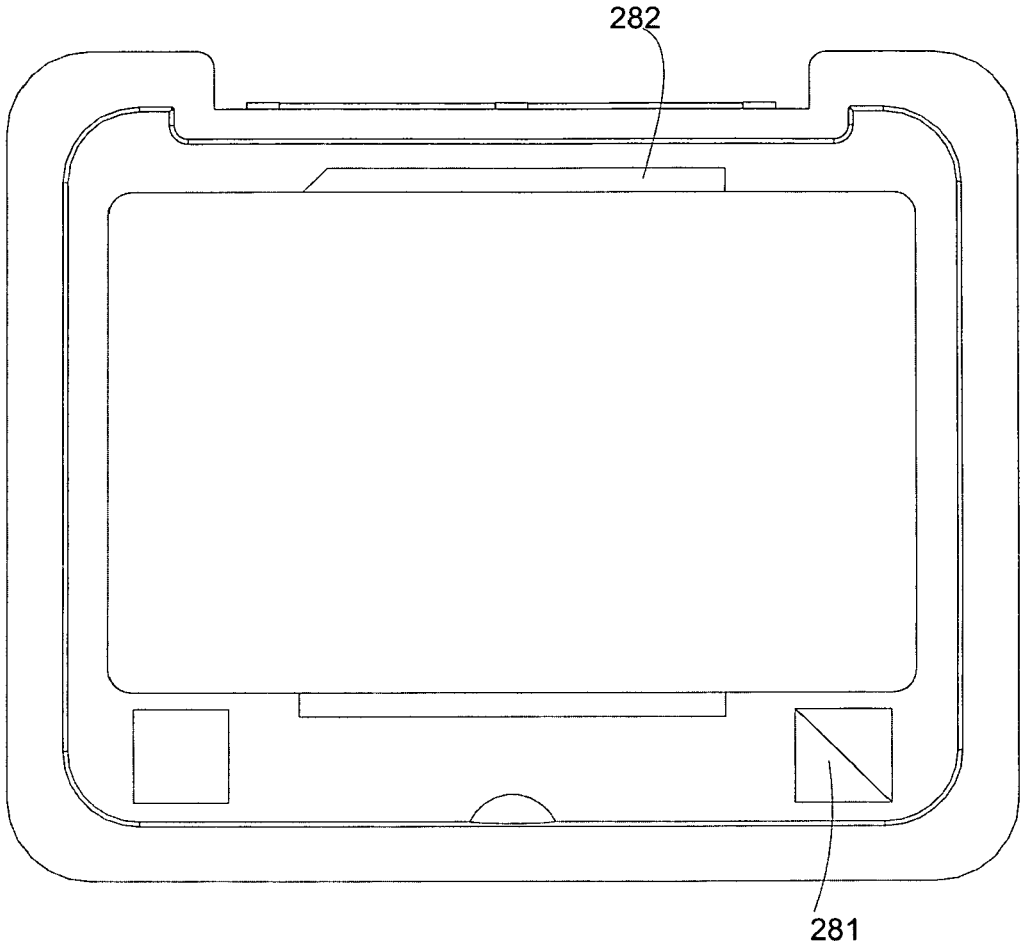
FIG. 3 is a rear plan view of the present invention.
Figure 4:
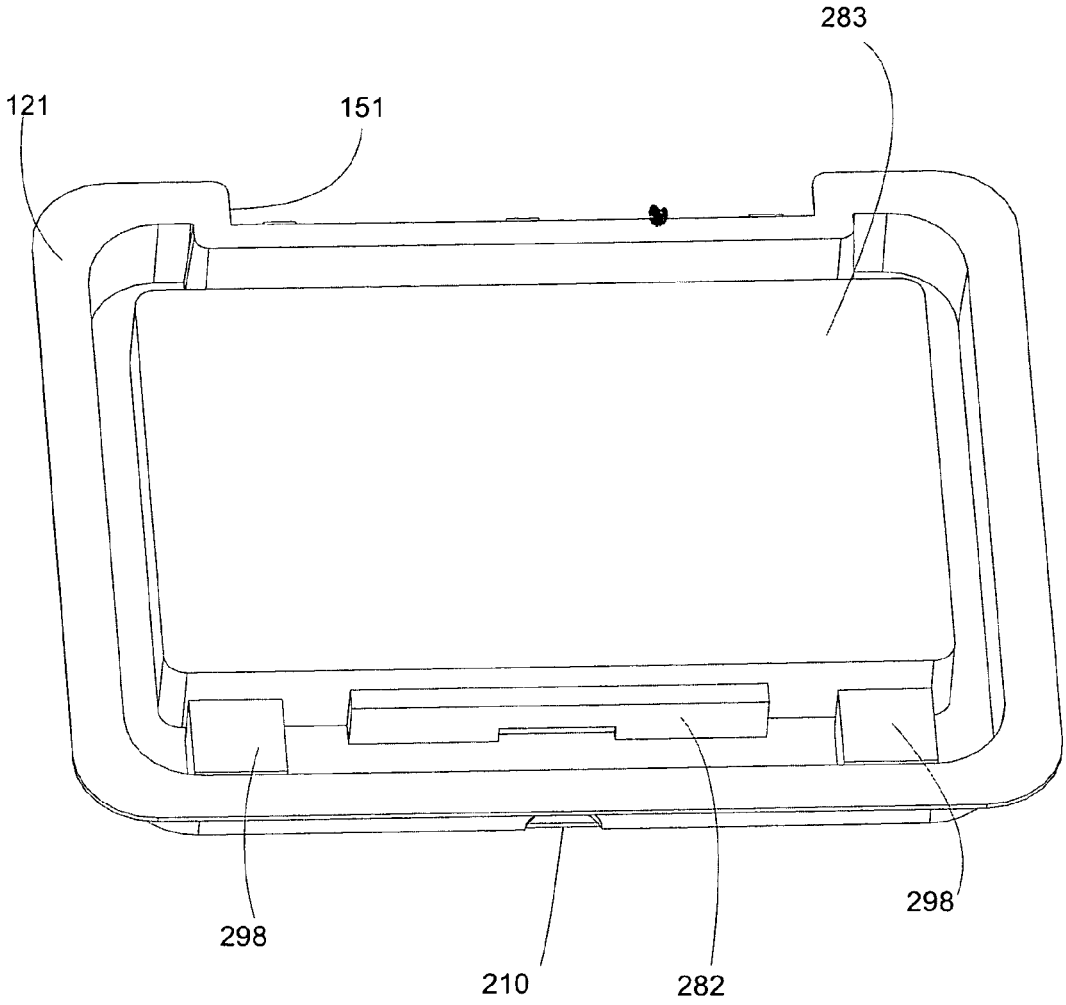
FIG. 4 is a rear perspective view of the present invention.

Optionally, the blister package further includes an SD card depression 282 for storing an SD sized and shaped flash memory card. The card depression 282 is above a rectangular depression 283. The memory card depression 282 is bounded at a top portion by a top tab 162, and bounded at a bottom portion by a bottom tab 161. The top tab 162 extends over a top edge of the memory card, and the bottom tab 161 extends over a bottom edge of the memory card. The rectangular depression forms a rectangular cavity below the memory card. The rectangular cavity can be used to store paper instructions, such as a folded sheet of paper. The front panel is preferably substantially flat, except for the window panel and the pair of button snaps. The pair of button snaps can be square button snaps 281, FIG. 3 or round button snaps 222, FIG. 2.

Figure 7:
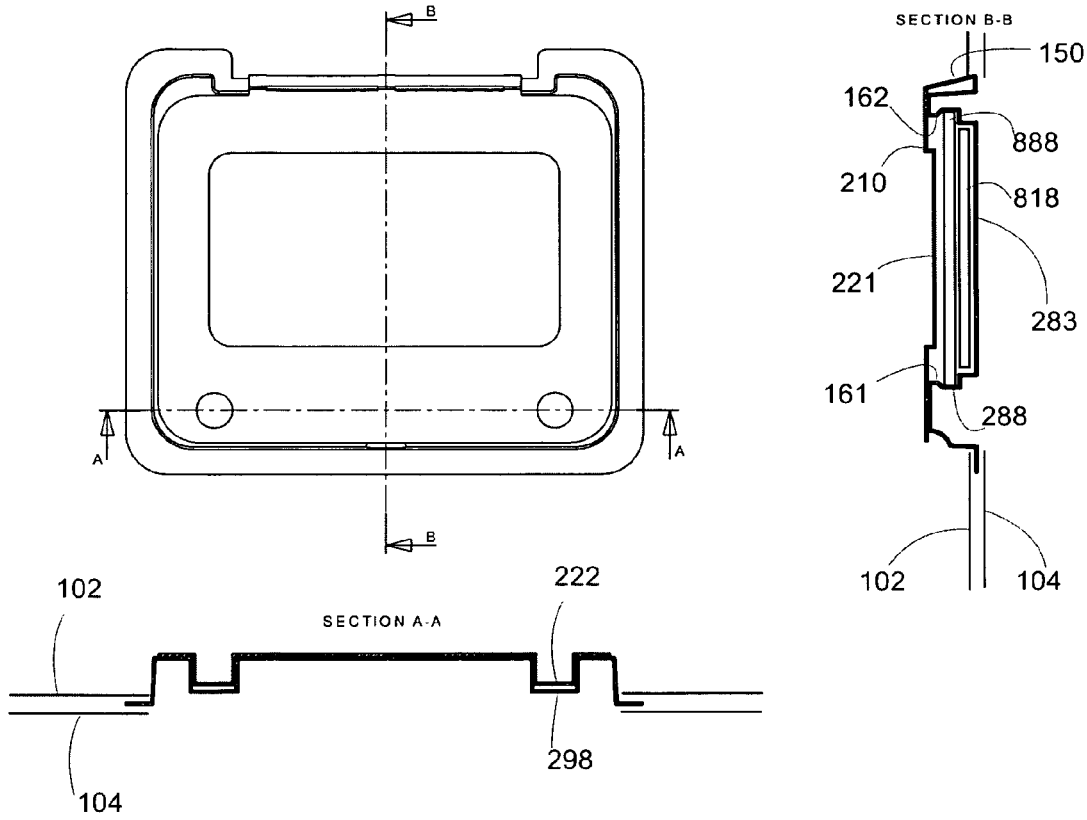
FIG. 7 is a cross-section view of the present invention.

FIG. 7 shows a cross section of the present invention. The flange is captured between the bifold card front member 102 and the bifold card rear member 104. The bifold card front member 102 can be printed on both sides, namely in color on the outside and in black and white on the inside. The bifold card rear member 104 can be printed on both sides, namely in color on the outside and in black and white on the inside. The bifold card can be glued at breakaway areas so that a user can unfold the card to reveal a black and white message printed between the bifold card front member 102 and the bifold card rear member 104.

In an alternate corner snap embodiment, the button snap can be formed as a corner snap 228. The corner snap 228 embodiment front panel is not flat, but rather has a depression on a bottom surface of the front panel with four corners extending downward. The rear panel plateau in the corner snap embodiment has four corner snap depressions 229 receiving four corners of the front panel. The alternate corner snap embodiment may include a package slot 284 for a rectangular article such as a USB Key. Alternatively, the package slot 284 can be in the shape of a memory card so that the package slot retains a memory card. The slot can also receive and be in the shape of a clamshell container for holding a memory card. Clamshell containers for holding memory cards are typically rectangular articles.

Figure 8:
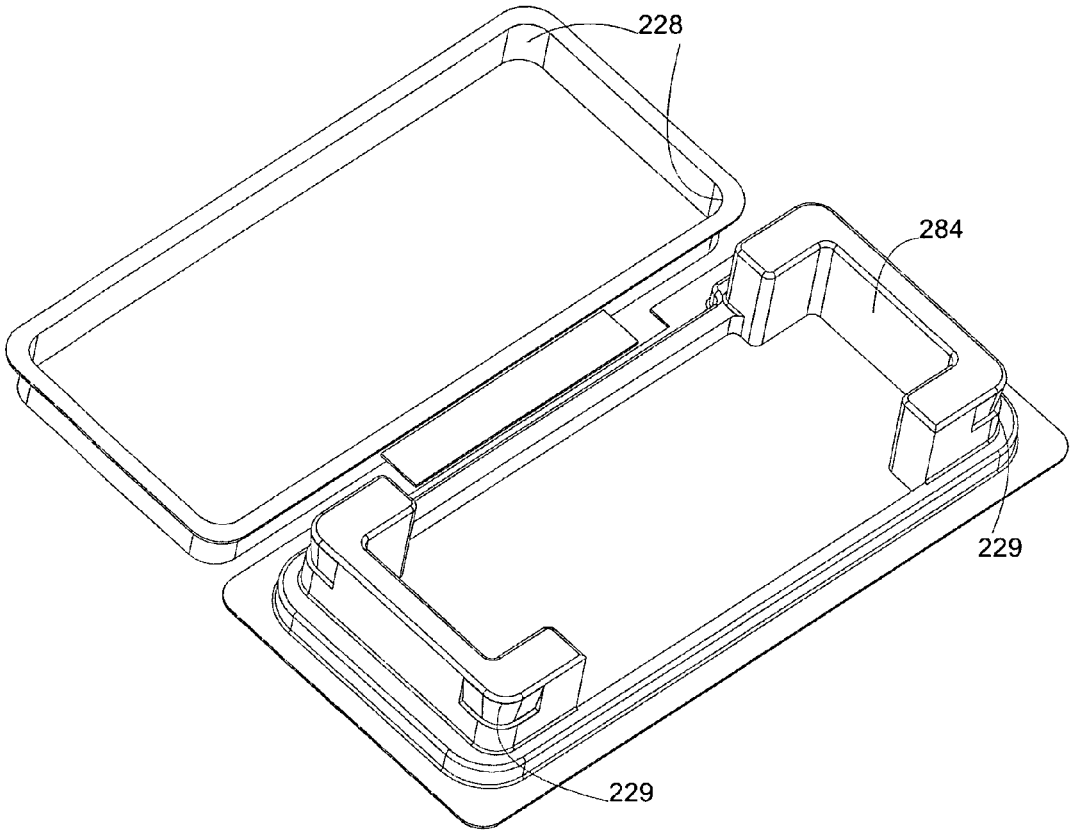
FIG. 8 is a perspective view of the alternate corner snap embodiment.

The corner snap embodiment FIG. 8, or other embodiments may further include a lower wall 140 extending around the rear panel plateau. A rear panel bottom wall gap 135 optionally provides a rectangular depression for retaining a rectangular object below the USB Key or memory card clamshell container. The rear panel bottom wall gap 135 can also be implemented instead of the grip depression 132. The rectangular object can be a small instruction booklet made of a folded sheet of paper. The rectangular object can also be promotional materials, advertising, a product manual, product registration or other paper product. FIG. 7 shows the location of printed material 818 relative to the location of a flash memory device 888. The flash memory device can be a USB Key or memory card, or any clamshell container with a USB Key or memory card inside.

A number of variations in the design of the present invention may be desirable. The intermediate panel can be made with only the intermediate panel front score, or with only the intermediate panel rear score so that there is a single joint on the intermediate panel instead of a double joint. The intermediate panel is made longer when single jointed. The intermediate panel becomes a part of the front panel when the intermediate panel front score is omitted, and the intermediate panel becomes a part of the rear panel when the intermediate panel rear score is omitted.

The blister package can be flipped upside down so that the button snaps are at the top and the hinge or hinges of the intermediate panel allow the front panel to fold downward. The blister package can also be oriented 90° to place the intermediate panel at a right side or left side, which allows the front panel to open like a book, or reversed from a standard book opening configuration when the intermediate panel is on the right side. The button snaps can be relocated on the front panel so that they are closer together in the middle, or further apart on the sides.

The button latch can be made as a round circular depression, a square depression, or a rectangular depression. The round button latch is preferred for insertion into a square button snap receiver. The button is a protrusion which has sidewalls that press against respective sidewalls of the snap receiver.

The package can also be reversed with respect to the card so that the product package front faces in an opposite direction away from the front panel rather than in the same direction with the front panel. Because the blister package is preferably made of transparent plastic, the reversal of the package when flipped provides viewing of the contents in the rectangular depression when the product is displayed. Package reversing can be accomplished simply by printing contents of the card so that the graphic printing of the card reverses the front of the package with the rear of the package.

Generally, it is preferred that the card 102 hold the blister package at the bottom with a large printable area above for providing graphics. However, depending upon the orientation of the graphics, the bottom of the card 102 could be the top of the card 102, or a side of the card 102. Simply printing the graphics in a different orientation can flip the blister package, or turn it in a variety of different directions. While it is not preferred to have a round blister package, or a round card 102, it is possible to have such configurations according to the stylistic needs of the retail market.

A user may remove the blister package from the card members by peeling apart the card front member from the card rear member. The user may then use the blister package as a compact carrying case. The flange corners are preferably rounded, and the corners of the front panel are also preferably rounded. The blister package is suited for storage of a flash memory device such as a USB drive or flash memory card.

The invention claimed is:

1. A small article package comprising:

a. a card front member having a card front member blister receiving opening;

c. a card rear member attached to the card front member, wherein the card rear member has a card rear member blister receiving opening;

d. a button depression releasably engaging a button snap in interference fit;

e. a blister package with a front panel, a rear panel, and a flange protruding from the blister package, wherein the flange extends between the card front member and the card rear member, wherein the blister package fits within the blister receiving opening which is sized to receive the blister package, wherein the front panel is hinged to the rear panel, wherein the button snap is formed on either the front panel or the rear panel for engaging the button depression formed on either the rear panel or the front panel;

f. a rear panel plateau on the blister package extending upward-from the flange; and g. a depression formed on the rear panel plateau for receiving a small article, wherein the front panel has an open position and a closed position, wherein the front panel opens from a front of the small article package to reveal an opening of the depression, wherein opening the front panel does not tear the card front member or the card rear member.

2. The small article package of claim 1, further comprising: a window panel depression on the front panel such that the front panel has a higher level so as to protrude less from a plane defined by the card front member than the window panel level.

3. The small article package of claim 1, further comprising: a lower edge of the rear panel plateau; and a grip depression formed as an indentation on the lower edge of the rear panel plateau.

4. The small article package of claim 1, wherein the button depression has a square or rectangular profile and wherein the button snap has a round profile.

5. The small article package of claim 1, further comprising: an intermediate panel hinged between the rear panel and the front panel, wherein the card rear panel is hingedly attached to the card front panel via the intermediate panel, wherein the intermediate panel has an intermediate panel rear score disposed between the intermediate panel and the rear panel in jointed configuration.

6. The small article package of claim 5, further comprising: an intermediate panel front score wherein the intermediate panel front score is disposed between the intermediate panel and the front panel, wherein the card rear panel is hingedly attached to the card front panel via the intermediate panel in a double-jointed configuration.

7. The small article package of claim 5, wherein the button depression has a square or rectangular profile and wherein the button snap has a round profile.

8. The small article package of claim 5, wherein the intermediate panel is located at a top side of the blister package.

9. The small article package of claim 8, further comprising an intermediate panel plateau notch formed in the rear panel plateau, and further comprising an intermediate panel flange notch formed in the flange of the rear panel, wherein the intermediate panel flange notch and the intermediate panel plateau notch provide leeway for folding of the intermediate panel over a top side of the blister package.

10. The small article package of claim 5, wherein the intermediate panel is located at a bottom side of the blister package.

11. The small article package of claim 1, wherein the button snap is formed as a corner snap on the front panel, and wherein the button depression is formed as a corner snap depression, wherein the corner snap releasably engages to the corner snap depression.

12. The small article package of claim 11, further comprising a lower wall circumscribing the rear panel plateau.

13. The small article package of claim 11, further comprising a rear panel bottom wall gap formed in the rear panel plateau.

14. The small article package of claim 1, wherein the depression formed on the rear panel plateau for receiving a small article is shaped to receive a flash memory USB drive.

15. The small article package of claim 1, wherein the depression formed on the rear panel plateau for receiving a small article is shaped to receive a flash memory card.

16. The small article package of claim 1, wherein the depression formed on the rear panel plateau is a rectangular depression, and further comprising a card depression in the shape of a flash memory card formed on the rear panel plateau, wherein the rectangular depression is deeper than the card depression, wherein the card depression includes a top tab for grasping a top edge of a flash memory card, and a bottom tab for grasping a bottom edge of a flash memory card, wherein the rectangular depression can be used for storing an article underneath the flash memory card.

17. The small article package of claim 1, further comprising: a window panel depression on the front panel such that the front panel has a higher level than the window panel level so as to protrude less from a plane defined by the card front member; a lower edge of the rear panel plateau; and a grip depression formed as an indentation on the lower edge of the rear panel plateau, wherein the button depression has a square or rectangular profile and wherein the button snap has a round profile.

18. The small article package of claim 1, further comprising: an intermediate panel hinged between the rear panel and the front panel, wherein the card rear panel is hingedly attached to the card front panel via the intermediate panel, wherein the intermediate panel has an intermediate panel rear score disposed between the intermediate panel and the rear panel in jointed configuration; and further comprising an intermediate panel front score wherein the intermediate panel front score is disposed between the intermediate panel and the front panel, wherein the card rear panel is hingedly attached to the card front panel via the intermediate panel in a double-jointed configuration, wherein the button depression has a square or rectangular profile and wherein the button snap has a round profile, wherein the intermediate panel is located at a top side of the blister package.

19. The small article package of claim 1, wherein the button snap is formed as a corner snap on the front panel, and wherein the button depression is formed as a corner snap depression, wherein the corner snap releasably engages to the corner snap depression; further comprising a lower wall circumscribing the rear panel plateau; and a rear panel bottom wall gap formed in the rear panel plateau, wherein the depression formed on the rear panel plateau for receiving a small article is shaped to receive a flash memory USB drive.

20. A small article package comprising:

a. a card front member having a card front member blister receiving opening;

b. a card rear member attached to the card front member, wherein the card rear member has a card rear member blister receiving opening;

c. a button depression releasably engaging a button snap in interference fit;

d. a blister package with a front panel, a rear panel, and a flange protruding from the blister package, wherein the flange extends between the card front member and the card rear member, wherein the blister package fits within the blister receiving opening which is sized to receive the blister package, wherein the front panel is hinged to the rear panel, wherein the button snap is formed on either the front panel or the rear panel for engaging the button depression formed on either the rear panel or the front panel;

e. a rear panel plateau on the blister package extending upward from the flange;

f. a depression formed on the rear panel plateau for receiving a small article;

g. an intermediate panel hinged between the rear panel and the front panel, wherein the card rear panel is hingedly attached to the card front panel via the intermediate panel, wherein the intermediate panel has an intermediate panel rear score disposed between the intermediate panel and the rear panel in jointed configuration, wherein the intermediate panel is located at a top side of the blister package; and h. an intermediate panel plateau notch formed in the rear panel plateau, and further comprising an intermediate panel flange notch formed in the flange of the rear panel, wherein the intermediate panel flange notch and the intermediate panel plateau notch provide leeway for folding of the intermediate panel over a top side of the blister package.

21. A small article package comprising:

a. a card front member having a card front member blister receiving opening;

b. a card rear member attached to the card front member, wherein the card rear member has a card rear member blister receiving opening;

c. a button depression releasably engaging a button snap in interference fit;

d. a blister package with a front panel, a rear panel, and a flange protruding from the blister package, wherein the flange extends between the card front member and the card rear member, wherein the blister package fits within the blister receiving opening which is sized to receive the blister package, wherein the front panel is hinged to the rear panel, wherein the button snap is formed on either the front panel or the rear panel for engaging the button depression formed on either the rear panel or the front panel;

e. a rear panel plateau on the blister package extending upward from the flange; and f. a depression formed on the rear panel plateau for receiving a small article, wherein the depression formed on the rear panel plateau is a rectangular depression, and further comprising a card depression in the shape of a flash memory card formed on the rear panel plateau, wherein the rectangular depression is deeper than the card depression, wherein the card depression includes a top tab for grasping a top edge of a flash memory card, and a bottom tab for grasping a bottom edge of a flash memory card, wherein the rectangular depression can be used for storing an article underneath the flash memory card.

* * * * *